US009591405B2

(12) United States Patent
Lakkundi et al.

(10) Patent No.: US 9,591,405 B2
(45) Date of Patent: Mar. 7, 2017

(54) AUTOMATIC AUDIO ENHANCEMENT SYSTEM

(71) Applicant: HARMAN INTERNATIONAL INDUSTRIES, INCORPORATED, Stamford, CT (US)

(72) Inventors: Ravi Lakkundi, Bangalore (IN); Vallabha Hampiholi, Bangalore (IN)

(73) Assignee: Harman International Industries, Incorporated, Stamford, CT (US)

( * ) Notice: Subject to any disclaimer, the term of this patent is extended or adjusted under 35 U.S.C. 154(b) by 377 days.

(21) Appl. No.: 13/673,637

(22) Filed: Nov. 9, 2012

(65) Prior Publication Data

US 2014/0133672 A1 May 15, 2014

(51) Int. Cl.

| | |
|---|---|
| ***H04R 1/00*** | (2006.01) |
| ***H04R 29/00*** | (2006.01) |
| ***H04R 3/12*** | (2006.01) |
| ***H04S 7/00*** | (2006.01) |

(52) U.S. Cl.

CPC ..... *H04R 3/12* (2013.01); *H04S 7/303* (2013.01); *H04R 2499/13* (2013.01)

(58) Field of Classification Search

CPC .... H04R 3/005; H04R 5/02; H04R 2201/401; H04R 2499/13; H04R 3/12; H03G 1/02; H03G 3/001; H04S 7/303

USPC 381/56, 58, 61, 71.4, 86, 92, 109, 71.1, 80, 381/104, 105, 107, 302, 365, 389; 455/3.01, 3.06, 41.3

See application file for complete search history.

(56) References Cited

U.S. PATENT DOCUMENTS

| | | | | |
|---|---|---|---|---|
| 8,531,602 | B1 * | 9/2013 | Tudor et al. | 348/485 |
| 8,913,757 | B2 * | 12/2014 | Hetherington | H04M 3/568 381/17 |
| 2005/0088517 | A1 | 4/2005 | Hsuan | |
| 2005/0237166 | A1 * | 10/2005 | Chen | B60R 25/1003 340/426.13 |
| 2007/0280486 | A1 * | 12/2007 | Buck | H04R 27/00 381/92 |
| 2008/0080700 | A1 | 4/2008 | Mock et al. | |
| 2010/0080401 | A1 * | 4/2010 | Holmi | H04S 7/307 381/86 |
| 2010/0201507 | A1 * | 8/2010 | Rao | B60R 21/01538 340/435 |

(Continued)

FOREIGN PATENT DOCUMENTS

| | | | |
|---|---|---|---|
| EP | 2043390 | A1 | 4/2009 |
| KR | 20120021060 | A | 3/2012 |

OTHER PUBLICATIONS

European Patent Office, Extended European Search Report Issued in Application No. 13191724.7, Dec. 7, 2016, Germany, 10 pages.

*Primary Examiner* — Vivian Chin
*Assistant Examiner* — William A Jerez Lora
(74) *Attorney, Agent, or Firm* — John D. Russell; B. Anna McCoy

(57) ABSTRACT

Described herein is an automatic audio enhancement system (AAES) that may locate, via aspects of an electronic device, objects and/or people within a target environment, such as inside a vehicle. The AAES also may change one or more audio output signals based at least on information associated with the location of the objects and/or people. In one example of the AAES, the locating of the objects and/or people may occur in association with operation of a mobile device.

15 Claims, 4 Drawing Sheets

(56) References Cited

U.S. PATENT DOCUMENTS

| | | | | |
|---|---|---|---|---|
| 2011/0194704 | A1* | 8/2011 | Hetherington | H04M 3/568 381/26 |
| 2012/0069242 | A1* | 3/2012 | Pearlstein | G10K 11/1788 348/484 |
| 2012/0214463 | A1* | 8/2012 | Smith et al. | 455/418 |
| 2013/0272536 | A1* | 10/2013 | Tzirkel-Hancock | H04S 7/303 381/86 |

* cited by examiner

AUTOMATIC AUDIO ENHANCEMENT SYSTEM

BACKGROUND OF THE INVENTION

1. Technical Field

The present disclosure relates to automatic enhancement of audio output based on a target listening position, and more particularly to automatic enhancement of audio output based on a target listening position obtained in association with use of a mobile device.

2. Related Art

An indoor positioning system (IPS), such as a mobile visual IPS (MoVIPS) may be used to wirelessly locate objects or people inside a building, enclosure, or vehicle. IPSs can use anchors (nodes within a known location) either to provide environmental context or locate tags for devices to sense. Such devices may include optical, radio, and acoustic based sensors.

SUMMARY

In one example of an automatic audio enhancement system (AAES), the system may perform, via aspects of one or more electronic devices, a method for locating objects and/or people within a target environment (such as inside a vehicle), and for changing one or more audio output signals based at least on information associated with the location of the objects and/or people. The AAES may include a receiver that receives location information of a user. The location information may be derived from one or more parameters, such as images captured by one or more sensors of the AAES or a mobile device of the user (such as a front-facing camera of a handheld device), and may be sent from the one or more sensors, such as one or more cameras, or the mobile device. The location information may be received by an audio signal processor included in the AAES. The audio signal processor may also process an audio signal with respect to at least the location information. After processing the audio signal, the audio signal processor may send the processed audio signal to one or more audio playback devices or loudspeakers.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system, such as an automatic audio enhancement system (AAES), may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
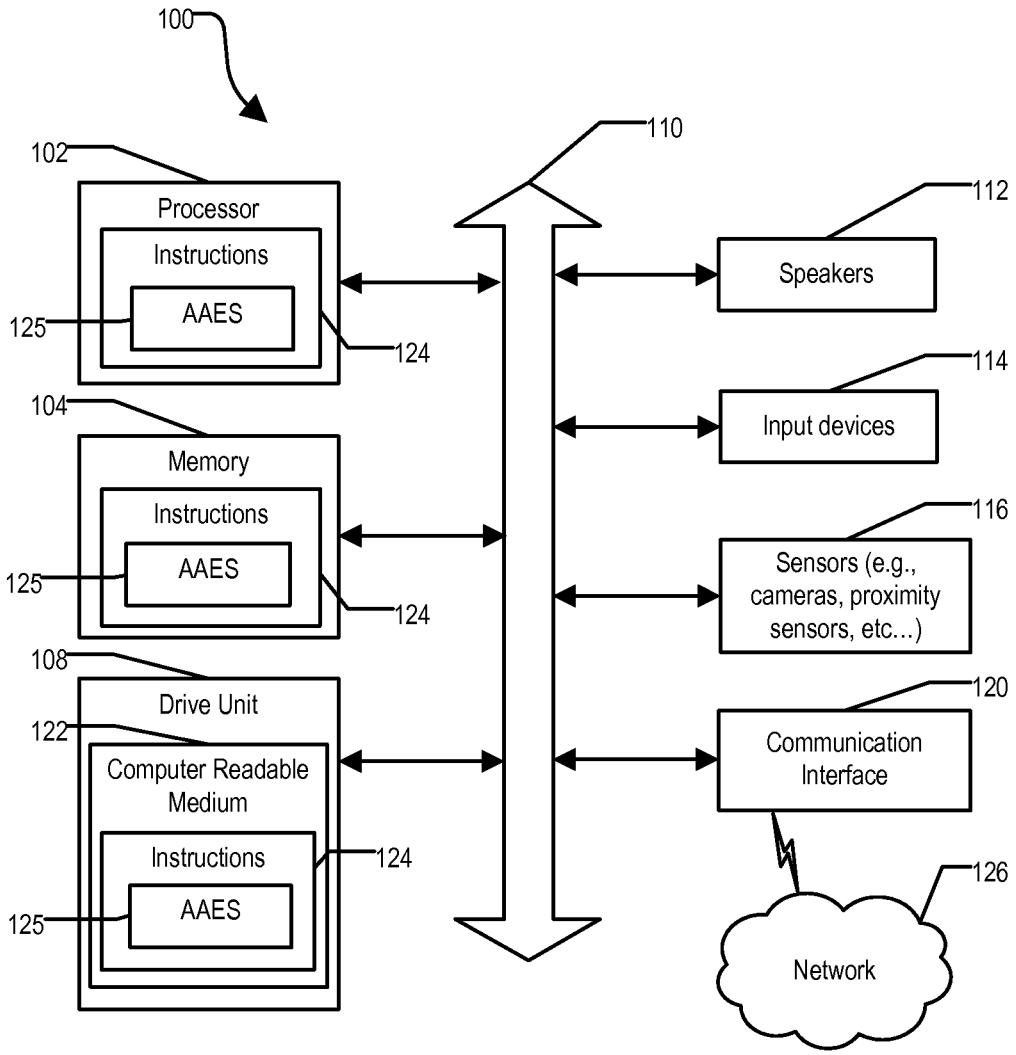
FIG. 1 illustrates a block diagram of an example electronic device that may include one or more aspects of an example AAES.

It is to be understood that the following description of examples of implementations are given only for the purpose of illustration and are not to be taken in a limiting sense. The partitioning of examples in function blocks, modules or units shown in the drawings is not to be construed as indicating that these function blocks, modules or units are necessarily implemented as physically separate units. Functional blocks, modules or units shown or described may be implemented as separate units, circuits, chips, functions, modules, or circuit elements. One or more functional blocks or units may also be implemented in a common circuit, chip, circuit element or unit.

In one example of an automatic audio enhancement system (AAES), the system may operate, via aspects of an electronic device, to capture location information of objects and/or people within a target environment, such as inside a vehicle or a living space, and to change one or more audio output signals based at least on information associated with the location of the objects and/or people in the target environment. In one example, capturing the location information may include identifying edges of, or amounts of, light emitted or reflected from the one or more objects or people. The captured location information may be compared against stored information associated with the target environment, such as historical information on edges of, or amounts of, light emitted or reflected from one or more objects or people typically present in the target environment. This comparison may be used to determine post-processing of an audio signal. The post-processed audio signal may be communicated to loudspeakers and produced as an audible sound. This provides for an enhanced audio experience for the user since the audio signal is adjusted based on the location of the user relative to the loudspeakers.

The audio experience may depend on a position of the user relative to the loudspeakers. Some other parameters that affect the audio experience include audio acoustics of the listening environment and the distance of the user from left, right, front, and back speakers, for example. In one scenario, where the user is seated at a driver's seat of a vehicle (front-left seat), a front-right door speaker of the vehicle is a different distance from the user than a front-left door speaker, meaning an outputted audio signal can arrive at the user's ears at different times (in that it is not phase aligned at a listening position of the user). To phase align the outputted audio signal, an audio signal to the front-left door speaker can be delayed to match timing of arrival of the front-right door speaker at the listening position. Delay is one example parameter that may be modified by a signal processor to enhance user perception of the sound field created by the audio output. Other parameters may include parameters related to gain and acoustic properties such as attenuation and backscatter.

The AAES may include a receiver that receives location information of a user. The location information may be derived from one or more parameters, such as images captured by one or more sensors of the AAES or a mobile device of the user (such as a front-facing camera of a handheld device), and may be sent from the one or more sensors, such as one or more video and/or still cameras, or the mobile device. The location information may be received by an audio signal processor included in the AAES. Also, the audio signal processor may process an audio signal with respect to at least the location information. After processing the audio signal, the audio signal processor may send the processed audio signal to one or more audio playback devices or loudspeakers. Regarding the audio signal processor, such a processor may be part of one or more desktop, laptop, or tablet computers, smartphones, portable media devices, household appliances, office equipment, set-top boxes, automotive electronics including head units and navigation systems, or any other electronic devices capable of performing a set of instructions executable by a central processing unit.

In one example of the AAES, the processing of an audio signal via the audio signal processor may include processing the audio signal with respect to at least one or more audio signal presets. Further, the presets may include one or more predetermined filters or delays associated with a predetermined potential location of the user. Where the target environment is a vehicle, for example, the predetermined potential location of the user may include one or more seats of the vehicle.

In another example of the AAES, the receiver of the AAES may receive handshaking information from the mobile device. In such an example, the one or more parameters, such as images, may be captured immediately after, before, or approximately at a same time as the receiving of the handshaking information. Also, the handshaking information may include location information of the user, in some examples.

In one example of the AAES, the handshaking information may include information to facilitate processes of negotiation, which sets parameters of one or more communication channels established between two entities before communication over the channels begin. This may include one or more channels established between the receiver of the AAES and the mobile device. Further, handshaking information may be used to negotiate parameters that are acceptable to equipment and systems at both ends of the one or more communication channels, including, information transfer rate, coding alphabet, parity, interrupt procedure, and other protocol or hardware features, such as location information.

In another example of the AAES, the sensors included in the AAES may sense a vehicle or living space sensor sensed location of the user. In such an example, the sensors may send location information based on the vehicle or living space sensor sensed location, from the one or more sensors to the audio signal processor of the AAES. In such an example, the processing of the audio signal via the audio signal processor may be with respect to at least this location information. In one example, the sensing of the vehicle or living space sensor sensed location information of the user may occur subsequent to the receiving of the handshaking information.

With respect to a mobile device, such as a smartphone or tablet computer of the user, the mobile device may be an aspect of the AAES and may include the receiver or the audio signal processor of the AAES.

With respect to the one or more parameters, such as images and location information, the one or more parameters may be images that include the user and surroundings of the user. The surroundings of the user may include one or more predetermined objects, such as windows behind or to one or more sides of the user, and location information may include one or more of sizes, shapes, or quantity of the one or more objects, such as windows. In one scenario, the one or more objects may be windows included as part of a vehicle. The surroundings of the user may also include one or more edges of one or more predetermined objects, such as ceilings, walls, or pieces of furniture behind or to one or more sides of the user. Location information may also include one or more lengths, curvatures, or quantity of the one or more edges of the one or more predetermined objects. Also, the surroundings of the user may include one or more edges of one or more ceilings, walls, or seats of a vehicle behind or to one or more sides of the user, and location information may include one or more lengths, curvatures, or quantity of the one or more edges of the vehicle's interior aspects.

With respect to the one or more sensors of the AAES, the sensors may include one or more sensors that detect or measure, motion, temperature, magnetic fields, gravity, humidity, moisture, vibration, pressure, electrical fields, sound, or other physical aspects of an environment surrounding the user. Also, in a scenario where a vehicle cabin contains the listening environment of the user, the one or more sensors of the AAES include one or more sensors that detect presence or location of a driver or passenger of the vehicle. For example, such vehicular sensors may include proximity sensors, airbag activation sensors, and seatbelt sensors. In short, these sensors detect which seat a user is occupying in a vehicle.

Furthermore, in one example of the AAES, the AAES may include a mobile device, such as a smartphone or a tablet computer. With respect to this example AAES, the mobile device may include a processor and a parameter capture device, such as a front-facing camera operable to capture one or more parameters, such as one or more images and/or video recordings (also described herein as the one or more images) of a user and surroundings of the user. Also, the front-facing camera may transmit data associated with the one or more images to the processor. Further, the mobile device may include a memory device that includes instructions executable by the processor to derive location information from the data associated with the one or more images. The mobile device may also include an interface operable to send the location information to an audio signal processor, where the audio signal processor is operable to process an audio signal with respect to at least the location information.

In yet another example of the AAES, the system may include a head unit that includes an audio signal processor. Further, the system may include one or more sensors operatively coupled to the head unit, where the one or more sensors are operable to collect location information of an occupant of the vehicle. Also, the system may include a control interface (such as a combination of one or more central processing units, communication busses, or input/output interfaces) that may be operatively coupled to the head unit, the one or more sensors, and/or one or more loudspeakers.

The control interface may be operable to receive handshaking information from a mobile device, such as a smartphone or tablet computer. In one example of the AAES, the handshaking information may be operable to activate the head unit. Also, the control interface may be operable to receive location information derived from parameters captured by the mobile device. For example, this location information may be derived from one or more images captured by a front-facing camera of the smartphone or tablet computer. Also, the parameters from which this location information is derived, such as one or more images or video recordings, may be captured immediately after, before, or approximately at a same time as receiving of the handshaking information. Finally, the control interface may be operable to send location information from various sources to the audio signal processor, which may be or include a signal processor of the head unit.

Regarding the audio signal processor, such a processor (being one or more modules) is operable to process an audio signal with respect to any type of location information described herein. A result of such processing is enhanced audio output in the form of a processed audio signal. The audio signal processor and/or the head unit may send the processed audio signal to the one or more loudspeakers via the control interface.

FIG. 1 is a block diagram of an example electronic device 100 that may include one or more aspects of an example AAES. The electronic device 100 may include a set of instructions that can be executed to cause the electronic device 100 to perform any one or more of the methods or computer based functions disclosed, such as locating objects and/or people within a target environment, such as inside a vehicle, and changing one or more audio output signals based at least on information associated with the location of the objects and/or people. The electronic device 100 may operate as a standalone device or may be connected, such as using a network, to other computer systems or peripheral devices.

In the example of a networked deployment, the electronic device 100 may operate in the capacity of a server or as a client user computer in a server-client user network environment, as a peer computer system in a peer-to-peer (or distributed) network environment, or in various other ways. The electronic device 100 can also be implemented as, or incorporated into, various electronic devices, such as desktop and laptop computers, hand-held devices such as smartphones and tablet computers, portable media devices such as recording, playing, and gaming devices, household appliances, office equipment, set-top boxes, automotive electronics such as head units and navigation systems, or any other machine capable of executing a set of instructions (sequential or otherwise) that result in actions to be taken by that machine. The electronic device 100 may be implemented using electronic devices that provide voice, audio, video and/or data communication. While a single electronic device 100 is illustrated, the term "device" may include any collection of devices or sub-devices that individually or jointly execute a set, or multiple sets, of instructions to perform one or more electronic functions. The one or more functions may include locating objects and/or people within a target environment, such as inside a vehicle, and changing one or more audio output signals based at least on information associated with the location of the objects and/or people.

The electronic device 100 may include a processor 102, such as a central processing unit (CPU), a graphics processing unit (GPU), or both. The processor 102 may be a component in a variety of systems. For example, the processor 102 may be part of a head unit in a vehicle. Also, the processor 102 may include one or more general processors, digital signal processors, application specific integrated circuits, field programmable gate arrays, servers, networks, digital circuits, analog circuits, combinations thereof, or other now known or later developed devices for analyzing and processing data. The processor 102 may implement a software program, such as code generated manually or programmed.

The term "module" may be defined to include a plurality of executable modules. The modules may include software, hardware, firmware, or some combination thereof executable by a processor, such as processor 102. Software modules may include instructions stored in memory, such as memory 104, or another memory device, that may be executable by the processor 102 or other processor. Hardware modules may include various devices, components, circuits, gates, circuit boards, and the like that are executable, directed, or controlled for performance by the processor 102.

The electronic device 100 may include memory, such as a memory 104 that can communicate via a bus 110. The memory 104 may be or include a main memory, a static memory, or a dynamic memory. The memory 104 may include any non-transitory memory device. The memory 104 may also include computer readable storage media such as various types of volatile and non-volatile storage media including random access memory, read-only memory, programmable read-only memory, electrically programmable read-only memory, electrically erasable read-only memory, flash memory, a magnetic tape or disk, optical media and the like. Also, the memory may include a non-transitory tangible medium upon which software is stored. The software may be electronically stored as an image or in another format (such as through an optical scan), then compiled, or interpreted or otherwise processed.

In one example, the memory 104 includes a cache or random access memory for the processor 102. In alternative examples, the memory 104 may be separate from the processor 102, such as a cache memory of a processor, the system memory, or other memory. The memory 104 may be or include an external storage device or database for storing data. Examples include a hard drive, compact disc ("CD"), digital video disc ("DVD"), memory card, memory stick, floppy disc, universal serial bus ("USB") memory device, or any other device operative to store data. For example, the electronic device 100 may also include a disk or optical drive unit 108. The drive unit 108 may include a computer-readable medium 122 in which one or more sets of software or instructions, such as the instructions 124, can be embedded. Not depicted in FIG. 1, the processor 102 and the memory 104 may also include a computer-readable medium with instructions or software.

The memory 104 is operable to store instructions executable by the processor 102. The functions, acts or tasks illustrated in the figures or described may be performed by the programmed processor 102 executing the instructions stored in the memory 104. The functions, acts or tasks may be independent of the particular type of instructions set, storage media, processor or processing strategy and may be performed by software, hardware, integrated circuits, firmware, microcode and the like, operating alone or in combination. Likewise, processing strategies may include multiprocessing, multitasking, parallel processing and the like.

The instructions 124 may embody one or more of the methods or logic described herein, including aspects or modules of the electronic device 100 and/or an example automatic audio enhancement system (such as AAES module(s) 125). The instructions 124 may reside completely, or partially, within the memory 104 or within the processor 102 during execution by the electronic device 100. For example, software aspects or modules of the AAES (such as the AAES module(s) 125) may include examples of the audio signal processor, which may reside completely, or partially, within the memory 104 or within the processor 102 during execution by the electronic device 100.

With respect to the audio signal processor, hardware or software implementations may include analog and/or digital signal processing modules (and analog-to-digital and/or digital-to-analog converters). The analog signal processing modules may include linear electronic circuits such as passive filters, active filters, additive mixers, integrators and delay lines. Analog processing modules may also include non-linear circuits such as compandors, multiplicators (frequency mixers and voltage-controlled amplifiers), voltage-controlled filters, voltage-controlled oscillators and phase-locked loops. The digital or discrete signal processing modules may include sample and hold circuits, analog time-division multiplexers, analog delay lines and analog feedback shift registers, for example. In other implementations, the digital signal processing modules may include ASICs, field-programmable gate arrays or specialized digital signal processors (DSP chips). Either way, such digital signal processing modules may enhance an audio signal via arithmetical operations that include fixed-point and floating-point, real-valued and complex-valued, multiplication, and/or addition. Other operations may be supported by circular buffers and/or look-up tables. Such operations may include Fast Fourier transform (FFT), finite impulse response (FIR) filter, Infinite impulse response (IIR) filter, and/or adaptive filters such as the Wiener and Kalman filters.

Further, the electronic device 100 may include a computer-readable medium that includes the instructions 124 or receives and executes the instructions 124 responsive to a propagated signal so that a device connected to a network 126 can communicate voice, video, audio, images or any other data over the network 126. The instructions 124 may be transmitted or received over the network 126 via a communication port or interface 120, or using a bus 110. The communication port or interface 120 may be a part of the processor 102 or may be a separate component. The communication port or interface 120 may be created in software or may be a physical connection in hardware. The communication port or interface 120 may be configured to connect with the network 126, external media, one or more speakers 112, one or more sensors 116, or any other components in the electronic device 100, or combinations thereof. The connection with the network 126 may be a physical connection, such as a wired Ethernet connection or may be established wirelessly. The additional connections with other components of the electronic device 100 may be physical connections or may be established wirelessly. The network 126 may alternatively be directly connected to the bus 110.

The network 126 may include wired networks, wireless networks, Ethernet AVB networks, a CAN bus, a MOST bus, or combinations thereof. The wireless network may be or include a cellular telephone network, an 802.11, 802.16, 802.20, 802.1Q or WiMax network. The wireless network may also include a wireless LAN, implemented via WI-FI or BLUETOOTH technologies. Further, the network 126 may be or include a public network, such as the Internet, a private network, such as an intranet, or combinations thereof, and may utilize a variety of networking protocols now available or later developed including TCP/IP based networking protocols. One or more components of the electronic device 100 may communicate with each other by or through the network 126.

The electronic device 100 may also include one or more speakers 112, such as loudspeakers installed in a vehicle or a living space. The one or more speakers may be part of a stereo system or a surround sound system that include one or more audio channels.

The electronic device 100 may also include one or more input devices 114 configured to allow a user to interact with any of the components of the electronic device. The one or more input devices 114 may include a keypad, a keyboard, and/or a cursor control device, such as a mouse, or a joystick. Also, the one or more input devices 114 may include a remote control, touchscreen display, or any other device operative to interact with the electronic device 100, such as any device operative to act as an interface between the electronic device and one or more users and/or other electronic devices.

The electronic device 100 may also include one or more sensors 116. The one or more sensors 116 may include one or more proximity sensors, motion sensors, or cameras (such as found in a mobile device); and/or the sensors may include user detection sensors such as sensors found in a living space or a vehicle. Such user detection sensors may include living space motion detectors and automotive safety-type sensors, such as seatbelt sensors and/or airbag sensors. Functionally, the one or more sensors 116 may include one or more sensors that detect or measure, motion, temperature, magnetic fields, gravity, humidity, moisture, vibration, pressure, electrical fields, sound, or other physical aspects associate with a potential user or an environment surrounding the user.

Figure 2:
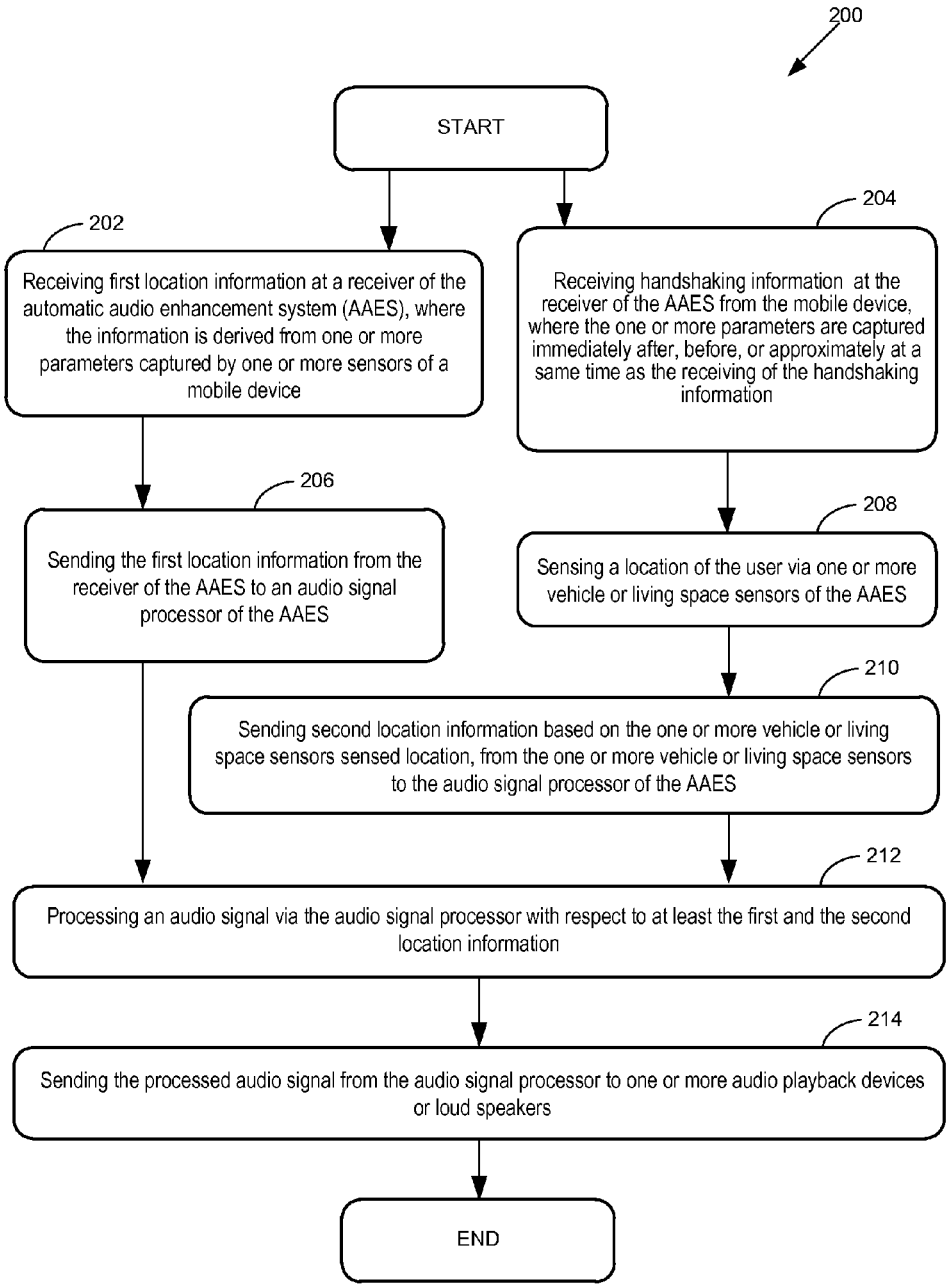
FIG. 2 illustrates an example operational flowchart that can be performed by one or more aspects of an example AAES, such as the one or more aspects of the electronic device of FIG. 1.

FIG. 2 illustrates an example operational flowchart that can be performed by one or more aspects of one example of the AAES, such as one or more aspects of the electronic device 100. Operation of the AAES may include capturing location information (such as optical based information) associated with one or more objects or people within a target environment (such as inside a vehicle or a living space), and changing one or more audio output signals/streams based at least on the location information. In one example, capturing the location information may include identifying edges of, or amounts of, light emitted/reflected from the one or more objects or people. Then the location information may be compared against stored information associated with the target environment, such as historical information on edges of or amounts of light emitted/reflected from one or more objects or people typically present in the target environment. This comparison then may be used to determine post-processing of an audio signal.

In one example of the AAES, a processor (e.g., the processor 102) can execute processing device readable instructions encoded in memory (e.g., the memory 110). In such an embodiment, the instructions encoded in memory may include a software aspect of the AAES, such as the AAES module(s) 125.

The example operation of the AAES begins with a starting event, such a user entering a living space or a vehicle cabin. After the starting event, at 202, the operation may continue with a first receiving aspect (such as an antenna of the one or more input devices 114) of the electronic device receiving first location information, where the information is derived from one or more parameters, such as one or more images captured by one or more cameras (such as one or more cameras of the sensors 116). In one example, the location information is sent from a mobile device of the user.

Also, after the starting event, at 204, the operation of the AAES may continue with a second receiving aspect (which may be the same element as the first receiving aspect) of the electronic device receiving handshaking information from the mobile device of the user. In one example, the one or more images may be captured immediately after, before, or approximately at a same time as the receiving of the handshaking information.

Next, at 206, the operation may continue with the first receiving aspect sending the first location information to an audio signal processor of the AAES. Also, as shown in FIG. 2 at 208, the operation may continue with one or more vehicle or living space sensors of the AAES (such as one or more sensors of the sensors 116) sensing a vehicle or living space sensor sensed location of the user; and then sending second location information based on the vehicle or living space sensed location to the audio signal processor of the AAES at 210.

Then, at 212, the operation continues with the audio signal processor (which may be one or more aspects of the AAES module(s) 125) processing an audio signal with respect to at least the first and/or the second location information. Finally, at 214, the operation continues with the audio signal processor sending the processed audio signal to one or more audio playback devices or loudspeakers.

Figure 3:
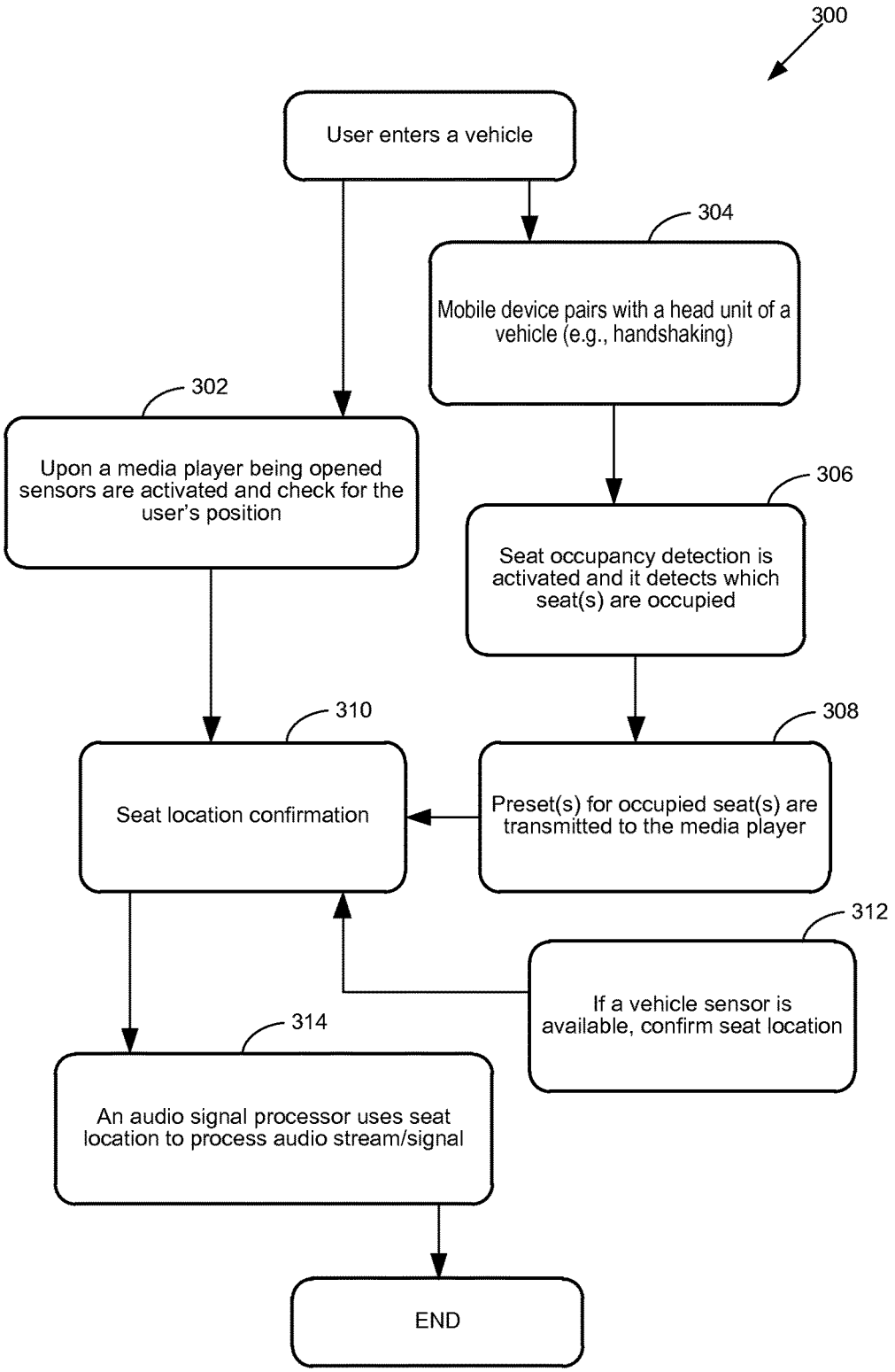
FIG. 3 illustrates another example operational flowchart that can be performed by one or more aspects of an example AAES, such as the one or more aspects of the electronic device of FIG. 1.

With respect to FIG. 3, depicted is an example operational flowchart that can be performed by one or more aspects of one example of an AAES, such as one or more aspects of the electronic device 100. In this example, the AAES may include one or more software aspects of the AAES stored in storage devices of a mobile device of a user and a head unit of a vehicle. The one or more software aspects may communicate via wireless technologies, such as one or more WI-FI or BLUETOOTH hardware or software technologies.

The operation begins with a user entering a vehicle cabin with his or her mobile device. For example, the user may enter the vehicle cabin and sit in a particular seat and/or seating position with his or her smartphone. After or upon the starting event, at 302, the user may activate a media player of the mobile device and/or the head unit of the vehicle, which may automatically activate one or more sensors, such as a front-facing camera on the mobile device or internal cameras in the vehicle. Alternatively, for example, when the user enters a vehicle, the mobile device may automatically activate and/or pair with the head unit of the vehicle, which in turn may also automatically activate the one or more sensors. Upon activation, the one or more sensors may capture one or more parameters, such as images, that identify a location and/or position of the user in the vehicle. For example, while the user is operating the mobile device (such as holding the device in one hand while operating it with the other hand) the mobile device may be tilted (such as intentionally or unintentionally tilted) at an angle (such as 60 to 120 degrees with respect to the ground) that allows a sensor such as a front-facing camera to capture one or more images of the user's head and surrounding objects. In this example, the operation of the mobile device allows the front-facing camera to capture one or more images of the user's head and objects such as windows and walls of the vehicle directly behind the user's head. Subsequently, location information can be determined from such images and confirmed by various sensors of the vehicle. Also, in cases where there are multiple occupants in the vehicle, respective front-facing cameras of mobile devices of the multiple occupants can capture one or more images of the multiple occupants and surrounding objects.

Also, after the user enters the vehicle, at 304, the mobile device (such as a smartphone) may handshake and pair with the head unit of the vehicle. After the handshaking and pairing, at 306, one or more sensors of the vehicle (such as safety-type sensors including seatbelt and airbag sensors), which may be communicatively coupled to the mobile device or the head unit, detect which seat(s) the user and/or other occupants of the vehicle are occupying. In one example, the one or more sensors installed in the vehicle may be sensors of the AAES. After, such detection, information associated with the user's location may be sent to the mobile device and/or the head unit from the one or more sensors, and the user's and/or other occupants' locations are determined.

Next, at 308, based on these determination(s), the mobile device and/or the head unit may send one or more audio levels presets to the media player. The presets may include one or more predetermined filters or delays associated with a predetermined potential location of the user. For example, presets and audio enhancement in a vehicle may be seat dependent. In a scenario where the user is seated in a right seat and a right side speaker is closer than a left side speaker, a preset may delay the audio signal of the right side speaker because the signal from the right side speaker travels a shorter distance to the user's ear. In short, speakers with varying distances from the user produce audio signals that reach the user's ears at different times. Therefore, one or more presets can counter delays of sound signals from sound sources of varying distances from the user. Also, the presets can adjust other acoustic parameters besides delay and such adjustments can be made per particular car model. Other acoustic parameters may include absorption, attenuation, and impulse response of a vehicle, for example. Also, parameters such as delay, absorption, attenuation, and impulse response may also be adjusted with respect to a number of occupants in a vehicle and their location in the vehicle. The presets may be provided by a vehicle manufacturer from the factory or over the Internet. For example, when a user downloads aspects of the AAES to his or her mobile device, the user may also download the presets for a particular vehicle and/or head unit. Also, such presets and audio enhancement may also be applied to other environments, such as living spaces and rooms.

Next, at 310, a processing aspect of the mobile device and/or head unit may confirm determinations of the user's and/or other occupants' locations. Such determinations may be confirmed against historical data or other determinations of the user's and/or other occupants' locations. The other determinations may include determinations from the one or more parameters, such as images, captured at 302 and determinations from sensors at 312, such as proximity sensors installed at various locations of the vehicle. Finally, at 314, one or more signal processing aspects (such as signal processing aspect(s) of the AAES module(s) 125), which may be included in the media player, post-process an audio signal played by the media player according to the determinations of the user's and/or other occupants' locations. For example, the processing of the audio signal may be according to seat locations of the occupant(s) of the vehicle.

Figure 4:
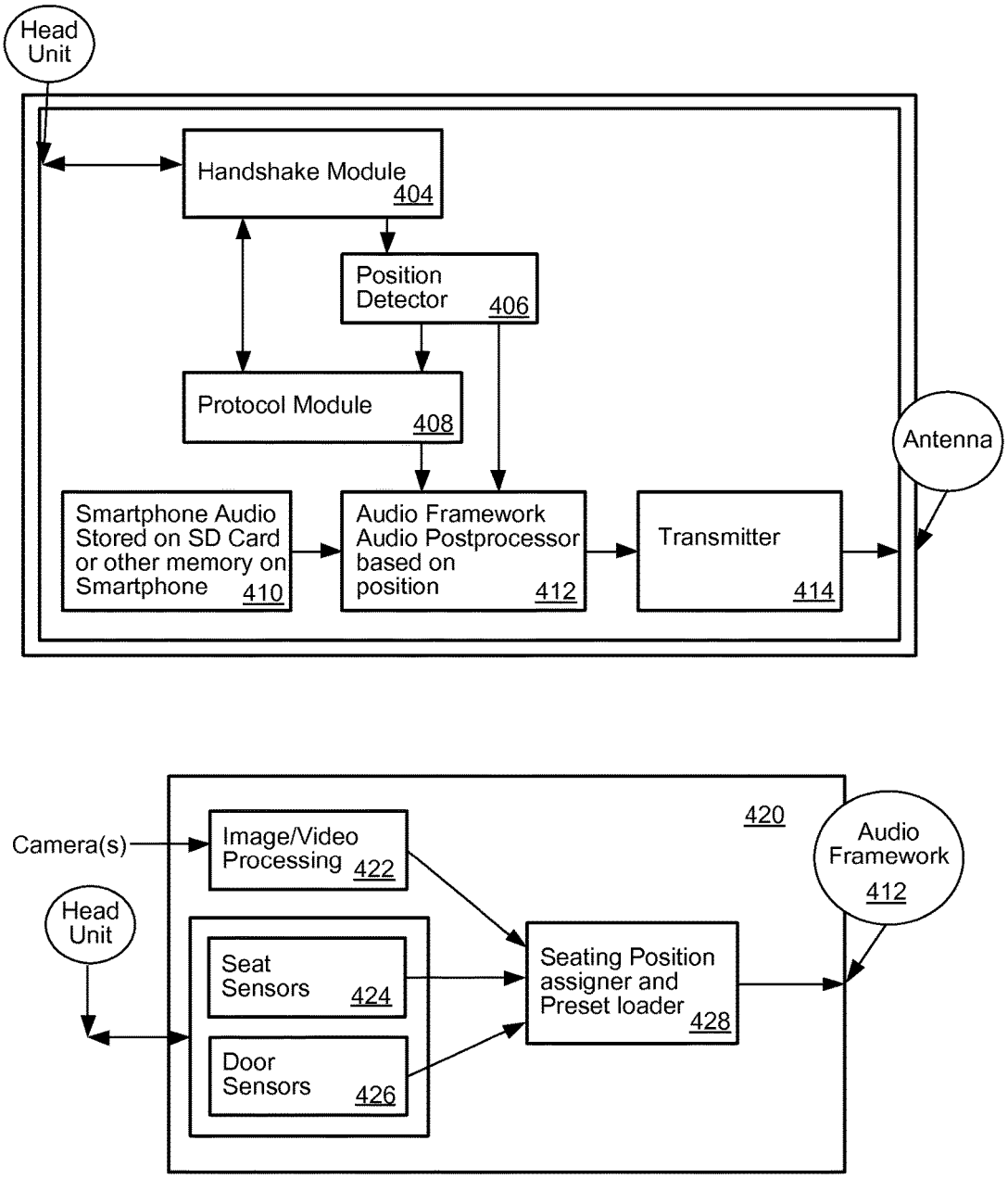
FIG. 4 illustrates example AAES module(s), such as the AAES module(s) of the electronic device of FIG. 1.

With respect to FIG. 4, depicted are example AAES module(s) such as the module(s) 125, which may be embedded or stored in a mobile device, such as a smartphone. These example modules may facilitate aspects of the example operations discussed with respect to FIGS. 2 and 3. As shown, a first aspect or module of the mobile device 402 may include a handshaking module 404 (such as a BLUETOOTH handshake module), a position identifier module 406, a protocol module 408, a memory or storage device 410, an audio framework 412 that includes audio processing based on user location information, and a transmitter 414, such as a BLUETOOTH transmitter. As depicted and as mentioned herein, a mobile device and a head unit may utilize handshaking, such as handshaking via the handshake module 404 and a respective module in the head unit. Handshaking information may be communicated to the location identifier module 406, which may identify location of a user with respect to loudspeakers. This location then may be communicated to the protocol module 408 for use with protocol related operations, such as BLUETOOTH related operations. Also, the location may be communicated to the audio framework 412. From the memory or storage device 410 audio files may be played by a media player of and/or operating with the audio framework 412. Post-processed audio signals (derived from the audio files and post-processed by the audio processing based on user location information) are communicated to a transmitter of the mobile device, such as the transmitter 414. The post-processed audio signals are then communicated to an antenna that is operatively coupled to the loudspeakers.

Also shown in FIG. 4, a second aspect or module of the mobile device 420 may include a parameter processing module 422, such as an image/video processing module 422, one or more sensor interface modules, such as modules 424 and 426, and one or more location assigner or preset loader modules, such as a module 428. User location information generated from the image/video processing module 422 and the one or more sensor interface modules may be further processed by the one or more location assigner or preset loader modules, and then forwarded to the audio framework 412. Alternatively, modules, such as modules 422-428 may be a part of the audio framework 412.

With respect to the one or more sensor interface modules, such modules may act as an interface to the head unit. For example, a module for seat sensors 424 and for door sensors 426 may facilitate signals communicated from such sensors that provide information pertaining to an amount and/or location of occupant(s) in a vehicle.

In one of the many examples of the AAES, once a person enters a vehicle or living space, a person's mobile device, such as a smartphone or handheld computer, may automatically synchronize with a head unit of the vehicle or set-top box of the living space. These devices pair automatically and may communicate audio signals using a wireless communication technology, such as BLUETOOTH or WI-FI. The mobile device, which captures a location of the person with respect to loudspeakers, may communicate the location to the head unit or set-top box that may control and/or process the audio signal outputted to the loudspeakers, where the control and/or processing of the signal may at least be based on the location of the person. In this example, besides determining location from a sensor of the mobile device, such as a front-facing camera of a handheld, location may be determined from handshaking between the mobile device and the head unit or set-top box.

In short, there are boundless applications and implementations of the AAES, including applications well beyond use of the AAES within a vehicle or a living space. As mentioned, the AAES can be applied to any other type of electronic device, including any one or more devices with sensors, cameras, speakers, and modules capable of identifying user location and adjusting audio output with respect to the user location.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method, comprising:

receiving, at a receiver of an automatic audio enhancement system (AAES), handshaking information from a mobile device of a user responsive to the mobile device entering a vehicle to pair the mobile device to the AAES;

receiving first location information of the user at the receiver of the AAES, where the first location information is derived from one or more parameters, the one or more parameters captured by one or more sensors responsive to pairing the mobile device to the AAES based on the handshaking information, wherein the mobile device of the user is an aspect of the AAES;

sending the first location information from the receiver of the AAES to an audio signal processor of the mobile device; and processing an audio signal via the audio signal processor with respect to at least the first location information and information regarding an acoustic environment in which the user is located.

2. The method of claim 1, where the one or more parameters include one or more images or video recordings and the one or more sensors include one or more still or video cameras, and where processing the audio signal further comprises adjusting one or more of attenuation and impulse response of the audio signal based on the first location information and information regarding the acoustic environment in which the user is located.

3. The method of claim 1, further comprising sending the processed audio signal from the audio signal processor to one or more audio playback devices or loudspeakers, and where processing the audio signal based on information regarding the acoustic environment in which the user is located further comprises processing the audio signal based on a model of the vehicle in which the user and the one or more audio playback devices or loudspeakers are located.

4. The method of claim 1, where the processing of the audio signal via the audio signal processor includes processing the audio signal with respect to at least one or more audio signal presets, and where the one or more audio signal presets include one or more predetermined filters or delays associated with a predetermined potential location of the user.

5. The method of claim 4, where the predetermined potential location of the user includes one or more seats of the vehicle.

6. The method of claim 1, where the one or more sensors are embedded in an aspect of the AAES or the mobile device of the user.

7. The method of claim 6, where the handshaking information includes negotiation information, the method further comprising setting communication parameters of one or more communication channels between the receiver of the AAES and the mobile device based on the negotiation information before communication over the one or more communication channels begins.

8. The method of claim 7, where the handshaking information includes the first location information of the user, and where the communication parameters comprise one or more of information transfer rate, coding alphabet, parity, and interrupt procedure.

9. The method of claim 1, further comprising:

receiving at the receiver of the AAES, second location information based on the vehicle or a living space sensor sensed location of the user, from one or more sensors of the vehicle or a living space; and processing the audio signal via the audio signal processor with respect to at least the first and the second location information, where the receiving of the second location information occurs responsive to receiving handshaking information at the receiver of the AAES.

10. The method of claim 1, where the one or more parameters include one or more images of the user and surroundings of the user.

11. The method of claim 10, where the surroundings of the user include one or more objects behind or to one or more sides of the user, and where the first location information includes one or more of sizes, shapes, or quantity of the one or more objects, where the one or more objects include windows that are part of the vehicle.

12. The method of claim 10, where the surroundings of the user include one or more edges of one or more windows, ceilings, walls, seats of the vehicle behind or to one or more sides of the user, or pieces of furniture behind or to one or more sides of the user, and where the first location information includes one or more lengths, curvatures, or quantity of the one or more edges.

13. The method of claim 9, where the one or more vehicle or living space sensors include one or more sensors that detect or measure at least one of motion, temperature, magnetic fields, gravity, humidity, moisture, vibration, pressure, electrical fields, or sound.

14. A system for automatic audio enhancement in a vehicle, comprising:

a head unit that includes an audio signal processor;

one or more sensors operatively coupled to the head unit, where the one or more sensors are operable to collect first location information of an occupant of the vehicle; and a control interface operatively coupled to the head unit, where the control interface is operable to:

receive handshaking information from a mobile device of a user responsive to the mobile device entering the vehicle to pair the mobile device to the system, where the handshaking information is operable to activate the head unit and the one or more sensors, the one or more sensors operable to collect the first location information of the occupant of the vehicle immediately after and responsive to the control interface receiving the handshaking information from the mobile device and pairing with the mobile device based on the handshaking information;

receive second location information associated with the occupant of the vehicle, where the second location information is derived from one or more parameters captured by a sensor of the mobile device, and where the one or more parameters are captured responsive to receipt of the handshaking information; and send the first and the second location information to the audio signal processor, where the audio signal processor is operable to process an audio signal with respect to at least the first and the second location information regarding an acoustic environment in which the user is located.

15. The method of claim 6, where the mobile device includes the receiver of the AAES.

* * * * *